United States Patent [19]

Caddy et al.

[11] Patent Number: 4,558,684

[45] Date of Patent: Dec. 17, 1985

[54] INTERNAL COMBUSTION ENGINE COIL-TYPE IGNITION CONTROL

[75] Inventors: Stephen W. Caddy, Handsworth Wood; Michael Holmes, Kings Heath, both of Great Britain

[73] Assignee: Lucas Industries public limited company, Birmingham, England

[21] Appl. No.: 632,428

[22] Filed: Jul. 19, 1984

[30] Foreign Application Priority Data

Jul. 21, 1983 [GB] United Kingdom ..... 8319694

[51] Int. Cl.[4] ..... F02P 3/045; F02P 3/05

[52] U.S. Cl. ..... 123/609; 123/644

[58] Field of Search ..... 123/609, 644

[56] References Cited

U.S. PATENT DOCUMENTS

| | | | |
|---|---|---|---|
| 3,838,672 | 10/1974 | Richards et al. | 123/644 |
| 4,121,556 | 10/1978 | Bigliani et al. | 123/644 X |
| 4,198,936 | 4/1980 | Pagel et al. | 123/609 |
| 4,248,195 | 2/1981 | Gorille | 123/609 X |
| 4,298,941 | 11/1981 | Furuhashi | 123/609 X |
| 4,347,570 | 8/1982 | Akiyama et al. | 123/609 X |
| 4,378,778 | 4/1983 | Harter | 123/609 |
| 4,467,776 | 8/1984 | Mezger et al. | 123/609 |

FOREIGN PATENT DOCUMENTS

| | | | |
|---|---|---|---|
| 200669 | 12/1982 | Japan | 123/644 |

*Primary Examiner*—Tony M. Argenbright

*Attorney, Agent, or Firm*—Staas & Halsey

[57] ABSTRACT

An ignition system with an ignition coil employs a power amplifier driven by a microprocessor for starting and interrupting coil current, in accordance with signals from an engine driven transducer. The power amplifier includes a current limiter, but this does not usually come into operation. Instead, the actual current flowing just before the instant of spark in each engine cycle is measured and the on time of the power amplifier is adjusted for the next cycle to cause the final current to approach a desired value less than the current limit value.

4 Claims, 6 Drawing Figures

INTERNAL COMBUSTION ENGINE COIL-TYPE IGNITION CONTROL

This invention relates to an internal combustion engine coil-type ignition control.

With coil type ignition a high voltage is generated at the instant of the spark by interrupting pre-established current flowing in the primary winding of the ignition coil. In its simplest form such a system utilises a switch element in series with the primary winding, which is turned on for a fixed fraction of each ignition cycle. The time taken for the coil current to grow to a satisfactory current level is fixed for a given system, (assuming the system voltage is unvarying) and it is thus apparent that the current is at or above a satisfactory level for a long period for each spark at low engine speed, but may fail to reach a satisfactory level at high engine speed.

Many coil-type ignition systems utilise a low resistance primary winding with no ballast resistor and employ a current limiting system to control the current in the primary winding. Such current-limiting involves operating the output switching device, usually a transistor, as an analog current control device, resulting in considerable power dissipation in the device. This involves the provision of satisfactory heat-sinking and, in any event, usually results in the device deteriorating more rapidly than a device which is used purely in a switching mode.

It has also previously been proposed to control the so-called "dwell period" i.e. the length of time for which the switching device is conductive, so as to maintain this period more or less constant over a wide range of engine speed. Open loop dwell controls have been proposed which control the instant of switch on in accordance with one or more measured variables, but since the dwell period required for satisfactory current growth can vary with battery voltage, temperature and coil age and also from coil to coil such controls tend to be unsatisfactory. Closed loop controls have also been proposed in which the current limit circuit operation is monitored and the dwell period is varied to maintain the current limit operation time at a predetermined level or a fixed fraction of the total ignition cycle period. Such closed loop control tend to operate very slowly and, in any event, still involve the switching element operating in linear mode in a substantial proportion of ignition cycles.

It is an object of the present invention to provide a coil-type ignition control with a closed loop dwell control in which the above mentioned disadvantages are substantially overcome.

In accordance with the broadest aspect of the present invention, there is provided a coil-type ignition control comprising a semiconductor output switching element for controlling coil current, means for switching said element on to commence coil current growth and off for creating a spark, and means sensitive to the level of current in the coil prior to switch off for varying the instant of turn on to cause the final coil current to approach a desired value in successive ignition cycles, the final coil current being capable of exceeding said desired value and being regulated to said desired value solely by varying the instant of turn on in normal running conditions.

In accordance with another aspect of the invention, there is provided a coil-type ignition control, having a semiconductor output switching element capable of acting as a linear current controlling device, for controlling the coil current, current limit means sensitive to the current passed by said switching element and operable to reduce the conductivity of said switching element should the current exceed a first predetermined level, and dwell control means controlling the period for which the switching element is conductive in each ignition cycle, said dwell control means comprising means for detecting the level of the current in the coil prior to switch off of said switching element in each ignition cycle and varying said period in a sense to cause the final current to approach a second predetermined level in the following ignition cycle, said second predetermined level being less than said first predetermined level.

The correction which is made to the dwell period in each cycle may be proportional to the error between the final current and the second predetermined level.

The invention also resides in a coil-type ignition control comprising a semiconductor output switching element capable of acting as a linear current controlling device, for controlling the coil current, current limit means sensitive to the current passed by said switching element and operable to reduce the conductivity of said switching element should the current exceed a first predetermined level, a resistor in series with the switching element, a voltage comparator connected to compare the voltage across said resistor with a reference voltage representing a second current less than first predetermined current level, and dwell control means sensitive to comparator output and controlling the final current reached in the coil immediately before switch off independently of the current limit means, by comparing the measured proportion of the dwell time for which the coil current exceeds said second current level with an "ideal" proportion and adjusting the dwell time in accordance with the magnitude of the error between such measured and ideal proportions.

With a system as described above the final current is normally determined by the dwell control means and the current limit means does not operate except during rapid deceleration or increase in system voltage. As a result the heat-sinking requirement of a conventional current limit operated system is substantially reduced and the life of the switching element can be expected to be significantly increased. Moreover, where the correction made in each cycle is proportional to the error, faster correction can be obtained without risk of instability.

Preferably, means are provided for overriding the dwell control means during cranking and turning the switch element on for a fixed fraction of each ignition cycle, the current limiting means being operative in such conditions.

IN THE ACCOMPANYING DRAWINGS

Figure 1:
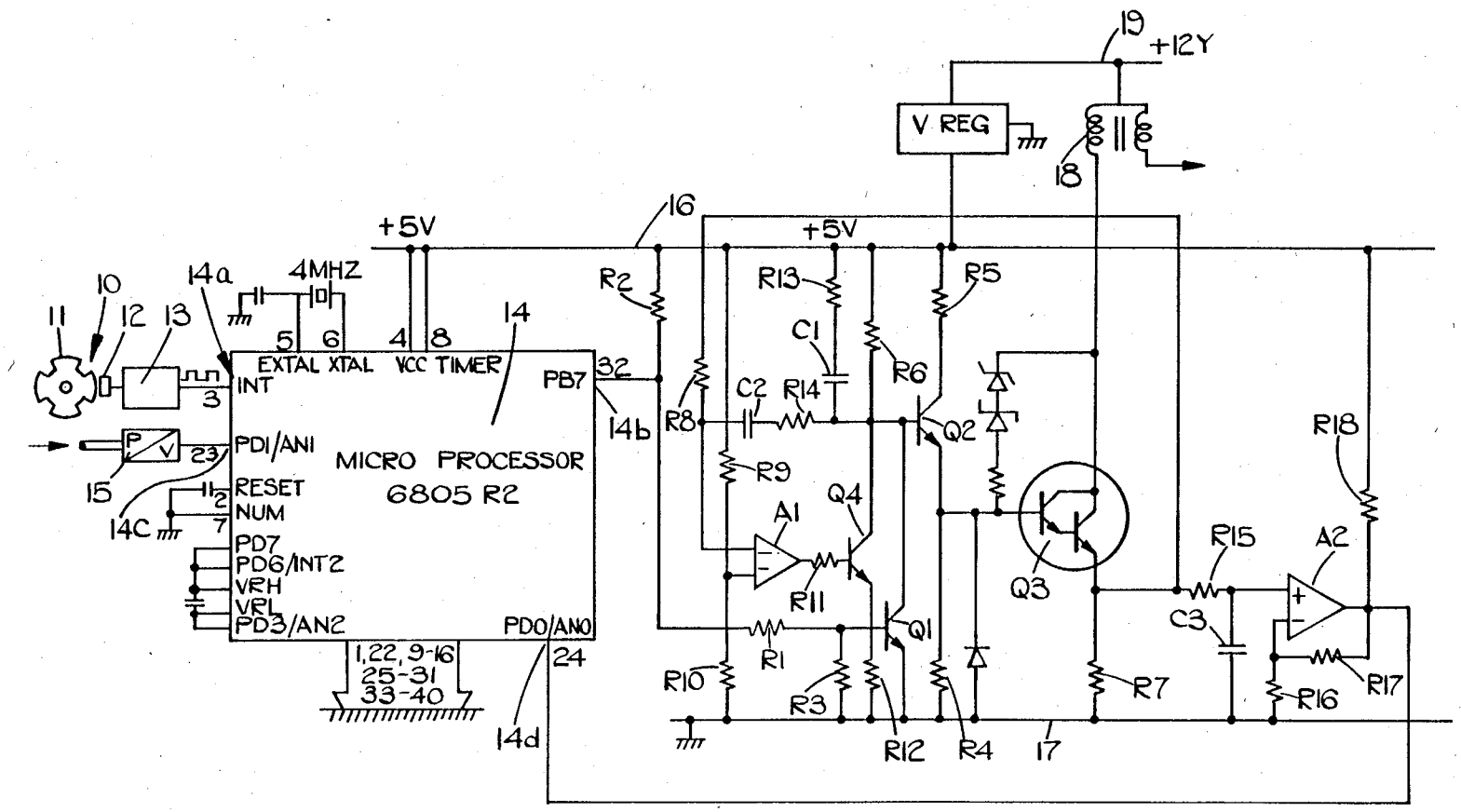
FIG. 1 is a diagram of one example of an ignition control in accordance with the invention.

Referring firstly to FIG. 1, the ignition control shown therein includes a crankshaft position transducer 10 which includes a rotor 11 driven at the engine timing shaft speed and a pick-up 12 which co-acts with the rotor and feeds an interface circuit 13 which provides a fixed mark/space ratio output with negative going transitions at the advance timing points for the respective cylinders of the engine. Such pick-up and interface circuit arrangements are very well known in the electronic ignition control art and will not be described in detail herein. The circuit 13 provides an input to an interrupt terminal 14*a* of a microprocessor circuit 14. The microprocessor circuit 14 is provided with a stored programme enabling it to process the signals received from the circuit 13 to provide speed data for use in advance characteristic routines of the programme and timing signals which are used to provide a coil on/coil off signals at an output terminal 14*b*.

Another input terminal 14*c* of the circuit 14 receives an analog signal from a pressure transducer 15 sensitive to the pressure in the engine air intake (downstream of the throttle butterfly). The input terminal 14*c* is connected internally to an analog-digital converter forming a part of the circuit 14 and the digital signals produced by this converter are used, in conjunction with the speed data for calculating the advance angle or period (i.e. the angle or period between the desired generation of a spark and the crankshaft reaching the following static timing position).

FIG. 1 also shows an amplifier circuit by means of which the output terminal 14*b* of the circuit 14 controls the commencement and termination of coil current flow. Such amplifier circuit includes an npn input transistor $Q_1$ to the base of which terminal 14*b* is connected by a resistor $R_1$. A resistor $R_2$ connects the terminal 14*b* to a +5V rail 16 and a resistor $R_3$ connects the base of the transistor $Q_1$ to a ground rail 17, the emitter of transistor $Q_1$ being connected to rail 17. The collector of the transistor $Q_1$ is directly coupled to the base of an npn drive transistor $Q_2$ which is biased to conduct by a resistor $R_6$ connecting its base to rail 16. Transistor $Q_2$ has its emitter connected by a resistor R4 to the rail 17 and its collector connected by a resistor R5 to the rail 16. The emitter of transistor $Q_2$ is directly connected to the base of an npn high voltage Darlington pair $Q_3$, the emitter of which is connected by a current sensing resistor $R_7$ to he rail 17. The collector of the Darlington pair $Q_3$ is connected via the coil primary winding 18 to the main 12V supply.

The amplifier circuit also includes coil current limit means, which is sensitive to the voltage generated across the resistor $R_7$. The resistor $R_7$ is connected via a resistor $R_8$, to the non-inverting input of an operational amplifier $A_1$ which has its inverting input connected to the junction of two resistors R9, R10 which are in series between the rails 16, 17. The output of amplifier $A_1$ is connected by a resistor $R_{11}$ to the base of an npn transistor $Q_4$ which has its emitter connected by a resistor $R_{12}$ to rail 17 and its collector connected to the base of the input transistor $Q_2$. The collector of transistor $Q_4$ is also connected by a resistor $R_{13}$ and a capacitor $C_1$ in series to rail 16 and by a resistor $R_{14}$ and a capacitor $C_2$ in series to the non-inverting input of amplifier $A_1$, so that the frequency response of amplifier $A_1$ is appropriately tailored, in known manner, to enable it to control the conduction of drive transistor $Q_2$ and consequently of the Darlington pair $Q_3$ and hold the coil current at a first predetermined limit level should such level be reached in any period when the transistor $Q_1$ is off.

The programme of the computer circuit 14 includes, however, a routine which controls the dwell period, i.e. the time for which the coil current is growing in each ignition cycle, and, in normal running, prevents the coil current reaching the limit level. To provide coil current data for this routine, there is provided another operational amplifier $A_2$ the output of which is connected to another input 14*d* of the circuit 14. Amplifier $A_2$ has its non-inverting input connected by a resistor $R_{15}$ to the resistor $R_7$ and by a capacitor $C_3$ to rail 17, resistor $R_{15}$ and capacitor $C_3$ forming a low pass filter. The inverting input of amplifier $A_2$ is connected by a resistor $R_{16}$ to rail 17 and by a resistor $R_{17}$ to its output terminal, at which there is connected a pull-up resistor $R_{18}$ connected to the +5V rail 16.

Figure 2:
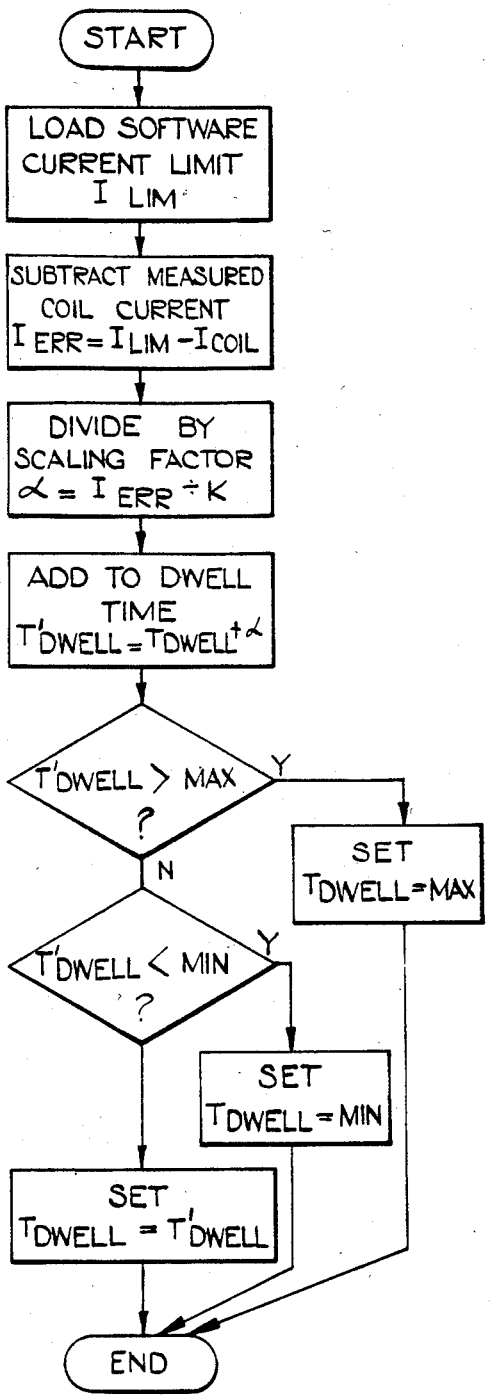
FIG. 2 is a flow sheet of a dwell control routine forming part of the programme of a micro-processor included in the control of FIG. 1.

The circuit 14 samples the signal from amplifier $A_2$ in each ignition cycle, shortly before coil current is interrupted as a result of the signal at terminal 14*b* going high. The analog-digital converter referred to then converts the analog signal received into digital data which is used in the dwell control routine of FIG. 2 to determine the dwell period for the next ignition cycle. The routine shown in FIG. 2 is self-explanatory and it will be recognised that, the routine provides a $T_{DWELL}$ data which is updated in every ignition cycle preparatory for the next ignition cycle, and this $T_{DWELL}$ data is used to determine the instant when the coil current is next turned on. The "software current limit" referred to in FIG. 2 is stored data representing a second predetermined current level which is lower than the first predetermined current level referred to above. The correction which is made to the $T_{DWELL}$ data in each ignition cycle is directly proportional to the error between this software limit data and the actual sampled current-dependent data.

With such an arrangement, the current limiting means, is not normally brought into operation, since the dwell control ensures that the first predetermined current level is not normally reached. In steady state conditions the software current limit level is achieved in each cycle. In acceleration, since the data is always one ignition cycle out of date, the software current limit level is not reached, but the proportional correction arrangement used ensures that a large droop does not occur. In rapid deceleration, the current limit means comes into operation and thereby limits the error.

Figure 3:
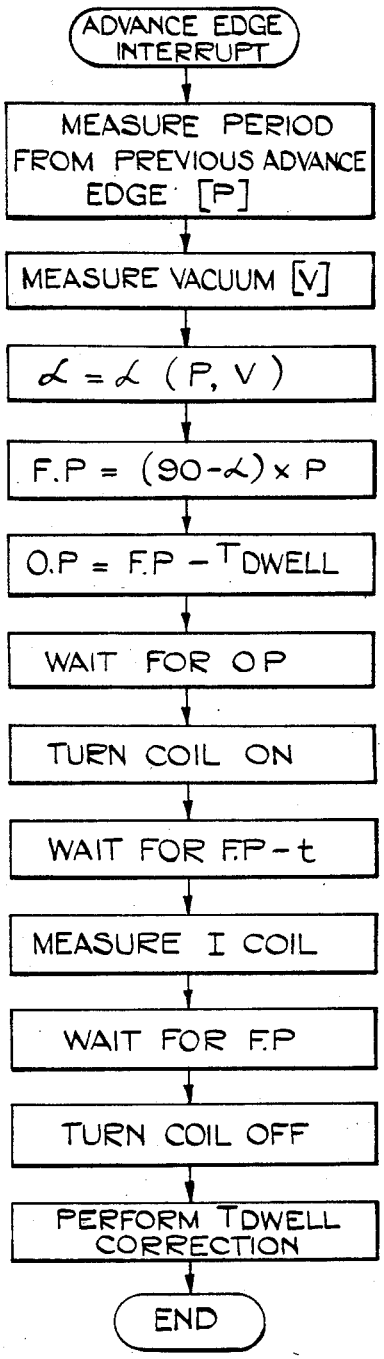
FIG. 3 is a flow sheet showing a routine for timing switch on and switch off of coil current.

Turning now to FIG. 3, the flow sheet shows the main programme routine of which the routine of FIG. 2 forms a part. The routine commences each time an advance edge interrupt signal is received at terminal 14*a*. Thereupon the period (P) elapsed since the previous advance edge was received is measured and the vacuum level (V) is measured. These variables P and V are used to determine the required advance angle utilising a look-up table and known interpolation techniques. The firing point F.P. is calculated by multiplying 90- by P and the coil turn-on point O.P is calculated by subtracting the existing $T_{DWELL}$ value from F.P. When O.P. arrives the coil current is switched on and at a time (F.P.-t), where t is a fixed time interval at least long enough to allow analog-to-digital conversion of the current signal, the coil current measurement or comparison result is inputted. At time F.P. the coil current is interrupted and the $T_{DWELL}$ correction routine is undertaken in readiness for the next cycle.

Figure 4:
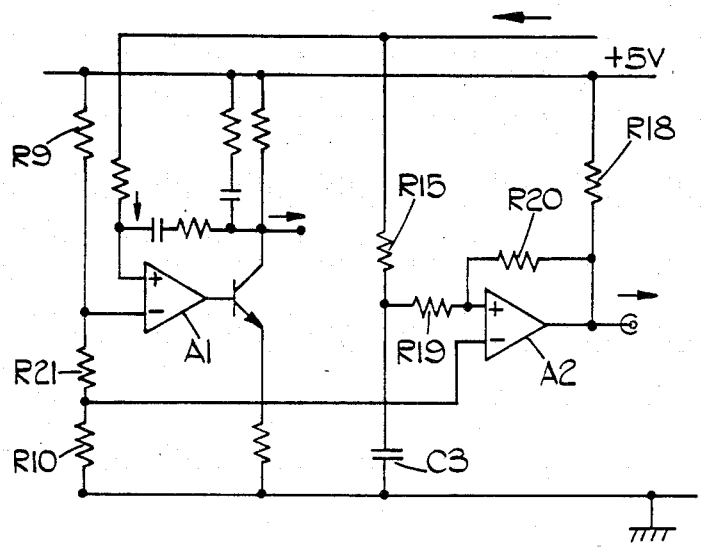
FIG. 4 is a diagram showing a modification to the control of FIG. 1.

In the modification shown in FIG. 4, the amplifier $A_2$ is connected to operate as a voltage comparator instead of as a linear non-inverting amplifier. To this end, the output of the filter $R_{15}$, $C_3$ is connected by a resistor $R_{19}$ to the non-inverting input of amplifier $A_2$ and a feedback resistor of relatively high ohmic value is connected between the output of amplifier $A_2$ and its non-inverting input. The inverting input of amplifier $A_2$ is connected to the junction of resistor $R_{10}$ with a resistor $R_{21}$ which is inserted in series with the resistor $R_9$ and $R_{10}$. The output of comparator $A_2$ goes high when the coil current is above a second predetermined current level. This second predetermined current level is set to about 75% of the desired final current level which may be lower than the first predetermined current level to which the coil current is limited, or which may be approximately equal to this first predetermined current level.

Figure 5:
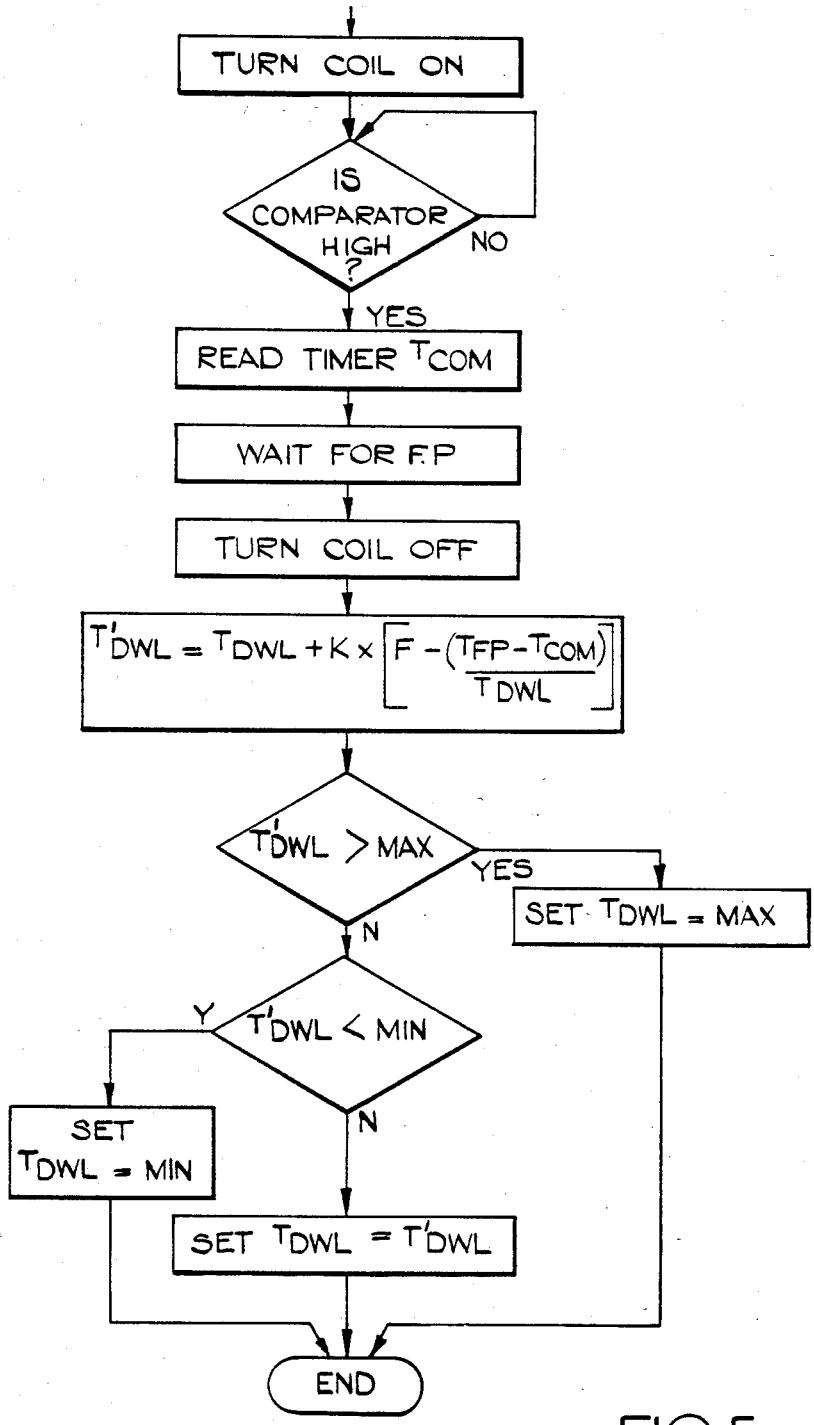
FIG. 5 is a partial flow sheet showing a modification of the routine of FIG. 3, when the modified control of FIG. 4 is employed.

The modified routine shown in FIG. 5 is utilised with hardware as shown in FIG. 4. In this case, the routine is arranged to provide a measure of the duration of the time interval during which the comparator output is high in each cycle. Thus, after coil turn on, the routine awaits the comparator output going high and notes the time $T_{COM}$ at which this occurs. The new $T_{DWELL}$ is calculated by adding to the existing $T_{DWELL}$ a correction proportional to the error between an ideal ratio F and the ratio of $T_{FP}$-$T_{COM}$ to $T_{DWELL}$. The ratio F is selected so that, in steady state the final current just reaches its desired value.

Figure 6:
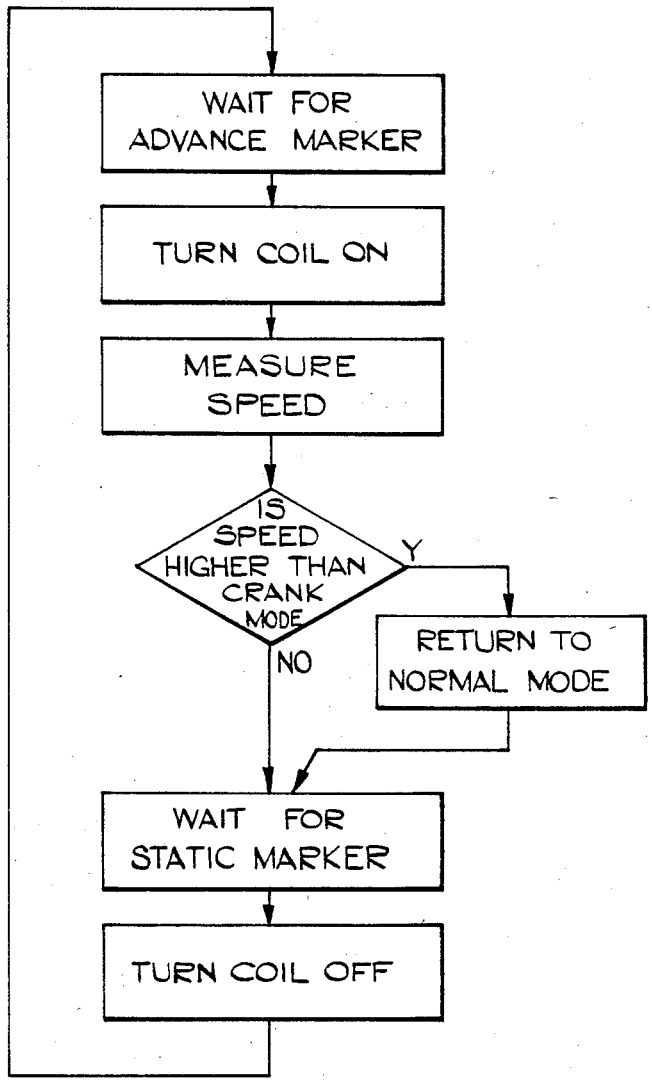
FIG. 6 is a flow sheet showing a dwell control routine used for controlling dwell during cranking.

Turning finally to FIG. 6, the flow sheet shown therein illustrates the routine used during cranking of the engine to turn the coil current on and off at fixed marker positions, rather than controlling the dwell period, which would be unsatisfactory at very low speed.

We claim:

1. A coil-type ignition control comprising:

semiconductor output switching means for controlling coil current;

means for switching said semiconductor output switching means on to commence coil current growth and off for creating a spark, the on time defining a dwell time; and current sensitive means for sampling the level of current in the coil immediately before switch off, for calculating the error between the sampled current and a desired value, and for adjusting the dwell time to cause the final coil current to approach said desired value in successive ignition cycles, the magnitude of the adjustment being proportional to the magnitude of the error, the final coil current being capable of exceeding said desired value and being regulated to said desired value solely by adjusting said dwell time in normal running conditions.

2. A coil-type ignition control as claimed in claim 1 comprising a transducer driven by the engine, a microprocessor circuit receiving input signals from said transducer, and a power amplifier driving the ignition coil from an output of the microprocessor, said current detecting means including a resistor in series with the coil, and a buffer connected to said resistor and to an input of the micro-processor to supply a current determined signal thereto for conversion to digital form and processing by the microprocessor.

3. A coil-type ignition control, comprising:

a semiconductor output switching means capable of acting as a linear current controlling device, for controlling the coil current;

current limit means sensitive to the current passed by said semiconductor output switching means and operable to reduce the conductivity of said switching means should the current exceed a first predetermined level; and dwell control means for controlling the period for which said switching means is conductive in each ignition cycle, said dwell control means including means for detecting the level of the current in the coil immediately before switch off of said switching means in each ignition cycle, for calculating the error between the sampled current and a desired value, and for adjusting said period in a sense to cause the final current to approach a second predetermined level in the following ignition cycle the magnitude of the adjustment being proportional to the magnitude of the error, said second predetermined level being less than said first predetermined level.

4. A coil-type ignition control as claimed in claim 3, comprising a transducer driven by the engine, a microprocessor circuit receiving input signals from said transducer, and a power amplifier driving the ignition coil from an output of the microprocessor, said current detecting means including a resistor in series with the coil, and a buffer connected to said resistor and to an input of the microprocessor to supply a current determined signal thereto for conversion to digital form and processing by the microprocessor.

* * * * *